United States Patent [19]

Salomon

[11] 3,987,553

[45] Oct. 26, 1976

[54] ADJUSTABLE SAFETY SKI BINDING SYSTEM

[76] Inventor: Georges Pierre Joseph Salomon, 34 Avenue de Loverchy, Annecy (Haute-Savoie), France

[22] Filed: Nov. 18, 1974

[21] Appl. No.: 524,545

Related U.S. Application Data

[62] Division of Ser. No. 287,072, Sept. 7, 1972, Pat. No. 3,857,186.

[52] U.S. Cl. ..... 33/192; 280/616

[51] Int. Cl.[2] ..... B43L 9/08; A63C 9/00

[58] Field of Search ..... 33/192, 191, 189, 3 R, 33/3 B, 3 C, 4; 280/11.35 E, 11.35 A, 11.37 T

[56] References Cited

UNITED STATES PATENTS

| | | | |
|---|---|---|---|
| 1,703,736 | 2/1929 | Jacob | 33/192 |
| 2,599,819 | 6/1952 | Fisher | 33/191 |
| 2,831,696 | 4/1958 | Jones | 280/11.35 E |

*Primary Examiner*—Richard E. Aegerter
*Assistant Examiner*—Willis Little

[57] ABSTRACT

The system includes: a reference point on the ski; front and rear jaws for maintaining the boot on the ski and disposed in a predetermined relationship relative to this reference point; a member fixed on the ski and adapted to receive each jaw in a slidable manner and including means for guiding the jaws longitudinally; an inversed drive mechanism connecting the jaws and acting along the longitudinal axis of the ski for moving simultaneously the jaws in opposite directions from and towards the reference point on the ski; and single control means operating the inverse drive mechanism.

11 Claims, 3 Drawing Figures

ADJUSTABLE SAFETY SKI BINDING SYSTEM

This invention relates to an adjustable system for adapting safety ski bindings as a function of the size of boot worn by the skier. This application is a division of U.S. Pat. application Ser. No. 287,072 filed Sept. 7, 1972. Now U.S. Pat. No. 3,857,186.

It is known that when safety bindings are mounted on a ski, it is customary to arrange for the front of the boot to be located substantially at the centre of the ski. More rarely, and depending on the type of run (downhill, slalom) the skier desires to undertake, the mounting may be such that the front of the boot is located slightly in front of, or on the contrary, slightly behind the centre of the ski.

In this connection, the centre of the ski serving as the reference point is actually defined for an average size boot (for example, size 40,5 for a 2 m ski). Now the majority of conventional ski bindings having a toe stop and a heel piece are designed in a manner such that the distance between them is adapted to different sizes of boot by moving only the heel piece. In other words, once the toe stop is attached to the ski, there is no way of altering the position thereof.

At the present time, only a few manufacturers provide means for altering the positions of the mounted bindings. Moreover, any such alteration involves adjustments independent of the heel piece and toe stop, which doubles the adjusting time.

Furthermore, there is no convenient way of ascertaining, at the time when the ski-bindings are being mounted, the optimal position for the holes used to assemble the bindings to the ski, this adjustment being carried out in a somewhat empirical manner.

It should also be pointed out that this possible double adjustment of the ski bindings is almost impossible to carry out at a ski resort, since it is a delicate and lengthy operation which would cut seriously into the skiing time available.

Thus quite unbelievable situations arise, especially in the case of rented skis, since a ski of a given length may be rented to one customer wearing a size 38 boot and to another customer wearing a size 45, with no change being made in the position of the toe stop.

Under these circumstances, the skis rented to the first customer would be suitable for a special slalom event, while the second customer could use them only for downhill skiing.

It will therefore be appreciated that if the customer uses the skis for a type of skiing for which they are not suitable, he may get into serious trouble and even fall.

It is an object of this invention to overcome this problem by means of a simple and economic solution which can be used by the skier himself.

More particularly, the present invention is concerned with ascertaining from a reference position corresponding to a standard boot size, the correct location of the safety bindings on a ski, in order to adapt the bindings to the size of boot worn by the skier. Moreover, this is achieved without altering the characteristics of the pair of skis.

To this end, the present invention is concerned with making the front and rear jaws mobile in the longitudinal axis of the ski so that they may be mechanically connected in a manner such that moving one jaw in one direction causes the other jaw to move in the other direction; the present invention makes it possible to act upon the mechanical connection between the jaws to displace them simultaneously in a single operation, until the jaws are located in a position such that the sole of the boot may be clamped and held to the ski.

The jaws may, of course, move at the same speed under the action of the mechanical connection, but in one preferred form of embodiment these movements take place at different speeds in relation to the ski. It is preferable that the heel piece move at a lower speed than the toe stop.

It will be noted that this ability, provided by the invention, to carry out adjustments at different speeds makes it possible to depart from the arrangement now in general use, whereby the front of the foot is in a substantially fixed position at the centre of the ski. This provides a considerable advantage from the point of view of efficiency and safety. Indeed, it has been found that, if the characteristics of the ski are to be maintained, the axis of the leg should be located at all times at the same point on the ski, regardless of the size of the boot worn by the skier.

The device according to this invention makes it possible to maintain the axis of the skier's leg at all times in the same location in relation to the ski, if the ratio between the respective speeds of movement of the jaws is made equal to the ratio between the distances between the axis of the leg and the front and rear ends of the sole.

Since the distance between the axis of the leg and the tip of the boot is approximately 3 times the distance between the axis of the leg and the heel of the boot, it is of advantage for the speeds in question to be in a ratio of 3 to each other.

In other words, if the front jaw moves at three times the speed of the rear jaw, the axis of the leg will at all times be at the same location in relation to the ski, regardless of the size of boot worn by the skier.

The present device is one in which the jaw components slide in a fixed structure comprising a means for longitudinal guidance, the jaws being connected to each other by a mechanism which drives them in opposite directions along the longitudinal axis of the ski, the mechanism having a single control.

Where the jaws move at different speeds, speed-reduction means co-operating with at least one of the jaws provided.

One advantage of the system according to the invention is that it may be used practically without modification:

for ascertaining the location of the permanent assembly holes in the ski;

for adapting a particular binding to various boot sizes (for example when skis are rented).

One preferred embodiment of the present invention will now be described in conjunction with the drawing attached hereto, wherein.

As already stated above, the system according to the invention is equally suitable for:

ascertaining the location of the holes for permanently assembling the safety binding to a ski, in relation to a position of reference, for a given size of boot; and adjusting the distance between the two elements of a binding mounted on a ski, this adjustment making it possible to adapt the binding to several boot sizes.

Figure 1:
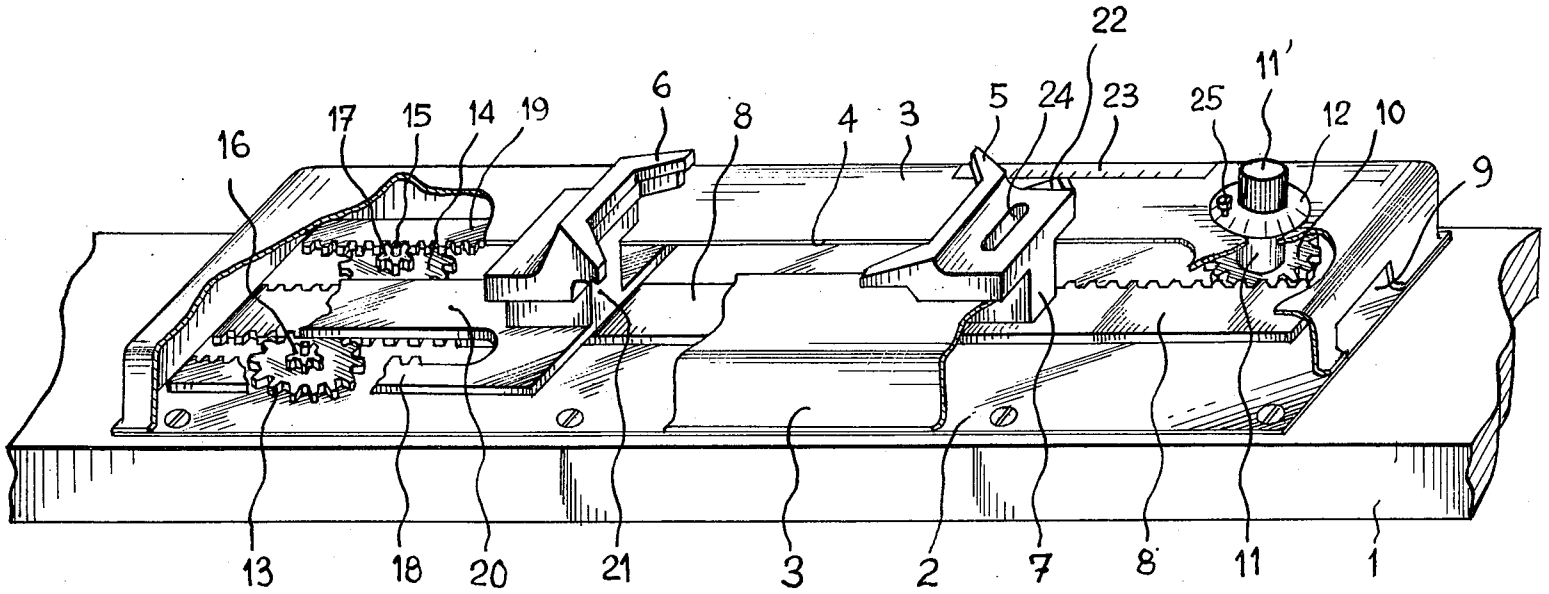
FIG. 1 is a schematic illustration in perspective of a device according to the invention having a rack-and-pinion drive particularly suitable for adjusting the safety bindings mounted on the ski.

In FIG. 1, the numeral 1 indicates the central portion of a ski, to which is attached, by means of screws for example, a base plate 2 enclosed in a housing 3 attached to plate 2 by any suitable means (screwing, crimping, welding, etc.). Housing 3 has a longitudinal slot 4 located along the axis of the ski, in which are located a front stop 5 and a heel piece 6. These will not be described in detail since they are conventional safety bindings. It is merely pointed out that the front stop has a downward extension 7 which passes into the housing and is integral with a primary rack 8 running practically along the entire length of the housing and adapted to protrude therefrom through windows 9 arranged in the ends thereof.

Ahead of stop 5, rack 8 engages with a control pinion 10 integral with a vertical shaft 11 rotatably mounted both in base plate 2 and in the upper housing 3. Shaft 11 serves to set the device to the size of boot, and may with advantage be equipped with a knob 11' carrying reference marks 12 making it possible to adjust the binding as a function of the size of boot worn by the skier.

Behind the heel piece, the rear end of rack 8 engages with two lateral pinions 13, 14 mounted to rotate freely about vertical axes 15 located in base plate 2 and housing 3.

Pinions 13, 14 are integral with pinions 16, 17 of reduced diameter engaging with the toothed branches 18, 19 of a secondary rack 20 integral with base 21 of heel piece 6 which extends across slot 4 in the housing.

It will be observed that front stop 5 may carry a pointer 22 moving along a scale 23 indicating the length of the ski.

It is preferable to provide an opening 24 in front stop 5 through which a mark corresponding to the centre of the ski may be seen when the housing is being assembled to the ski. Of course, base plate 2 also has an opening which exposes the mark.

In order that the mark indicating the centre of the ski may be visible through opening 24, the distance between the toe stop and the heel piece must be equal to the standard boot size, i.e. 40,5 for a ski 2.5 m in length; in this case, pointer 22 on the stop points to the mark on the scale corresponding to the length of the ski used.

In order to lock the toe stop and the heel piece in relation to each other as soon as the device has been set to the boot size, means may be provided to lock knob 11' to the housing. Any known arrangement may be used for this purpose, for example a spring finger 25 engaging in one of a series of holes in the surface of the housing.

The operation of the device described above is very simple, and may be gathered from the description thereof. It will be observed that in the particular case illustrated, the heel piece moves at one third of the speed of the front stop, since the step-down ratio between the pairs of pinions 13 – 16 and 14 – 17 is 1:3.

Figure 2:
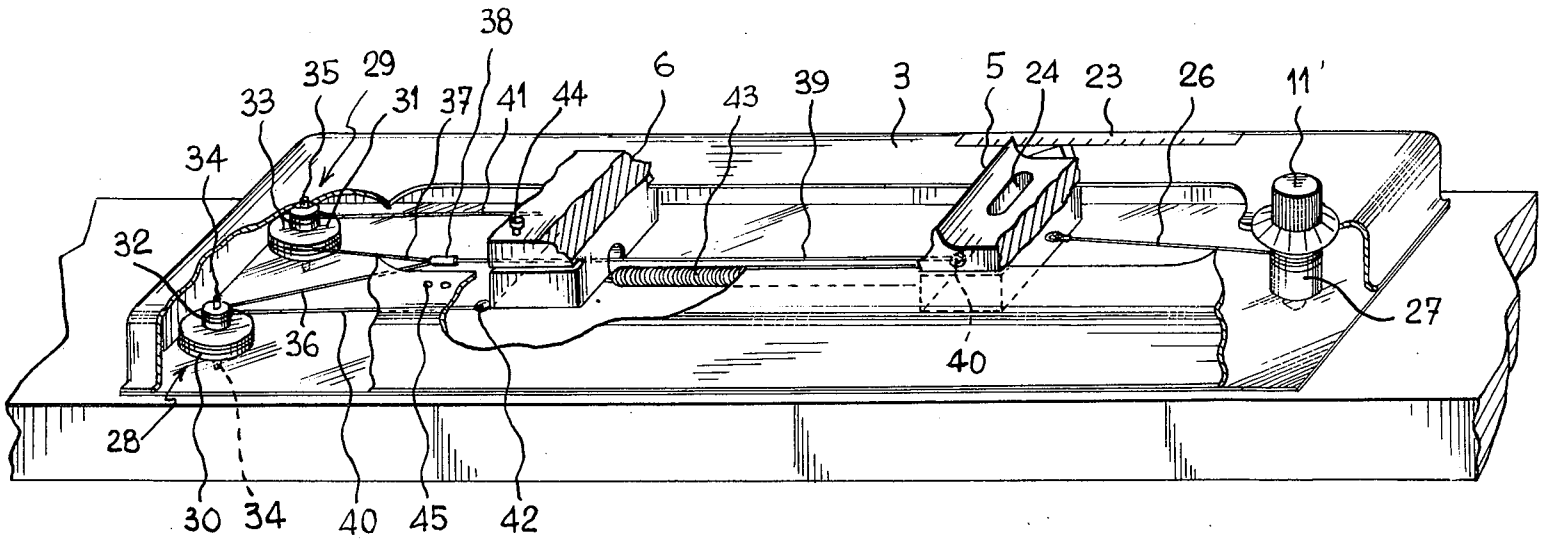
FIG. 2 is a view, similar to the one in FIG. 1, in which the drive consists of a system of cables.

FIG. 2 illustrates an arrangement similar to that in FIG. 1 except that the rack and pinion is replaced by a system of cables. By way of simplification, FIG. 2 (like FIG. 3) shows only those parts of the jaw structure such as are required in order to understand the invention, it being understood that the system may be applied, as has been seen in connection with FIGS. 1 and 2, both in conjunction with drilling templets and when safety bindings are directly available. Hooked to the front face of front jaw 5 is a cable 26 which winds around shaft 27 of the size-setting knob, to which one end of cable 26 is attached.

Located behind rear jaw 6 are two pairs of pulleys 28, 29, each consisting of a large-diameter pulley 30, 31 and a smaller diameter pulley 32, 33, the pulleys being integral with common vertical axes 34, 35.

Attached to large pulleys 30, 31 are the ends of cables 36, 37 which pass around the pulleys and unite at 38 with the end of an axial cable 39, the opposite end of which is attached at 40 to the rear face of jaw 5.

Attached to small pulleys 32, 33 are the ends of two secondary cables 40, 41, the opposite ends of which are hooked at 42 to the rear face of rear jaw 6.

A spring 43 is preferably hooked between the front and rear jaws and urges these two elements towards each other. It is, of course, quite conceivable that the rear jaw could be pushed or pulled towards the front jaw by means of a spring, or any other resilient system, arranged differently from spring 43 but performing the same function.

In this variant, especially when a safety system is used, it will be of advantage, after the size-setting operation, to lock the front and rear jaws in relation to the ski, in order to prevent any unwanted movement thereof while skiing. Use may be made of a locking system similar to that in FIG. 1, namely, a spring finger 44 engaging in one of a series of holes 45 in the housing.

Figure 3:
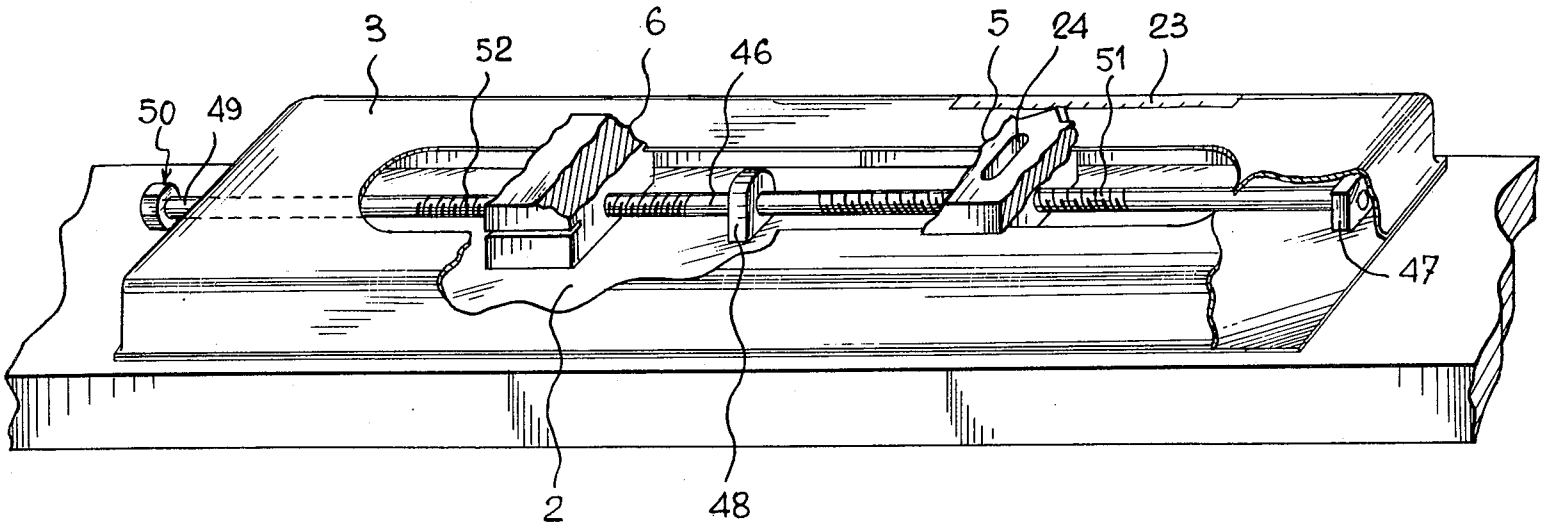
FIG. 3 is a view, similar to those in FIGS. 1 and 2, in which the drive system for the retaining element is a screw.

A description will now be given of the device illustrated in FIG. 3. In this case, the mechanical size-setting system consists of a rod 46 running inside the housing along the longitudinal axis of the ski, the rod being mounted in the housing in a manner such that it is free to rotate therein but cannot move axially. To this end, the forward end of the rod is mounted in a stationary bearing 47 integral with the housing and in an intermediate bearing 48 integral with baseplate 2.

Bearings 47 and 48 are of a conventional type which allows the rod to rotate without moving axially. Rear end 49 of the rod protrudes from housing 3 and carries an adjusting knob 50. The rod also has two threaded zones 51, 52 running respectively between bearings 47 and 48 and between bearings 48 and knob 50. Threads 51, 52 are of opposite hand, for instance thread 51 may be right-handed and thread 52 left-handed. Thread 51 co-operates with a threaded hole in the structure of front jaw 5, while thread 52 engages with a threaded hole in the structure of rear jaw 6. Finally, in order that the front jaw may move at 3 times the speed of the heel piece, the pitch of thread 51 is 3 times that of thread 52.

It is to be understood that the rotation of rod 46 by means of knob 50 causes the front and rear jaws to move simultaneously towards or away from each other (depending on the direction of rotation of the said rod).

What is claimed is:

1. In combination, a ski having a predetermined reference point thereon, and an adjustable safety ski binding system for adapting the binding to the size of various skier boots, said binding system comprising: front and rear adjustable jaws for maintaining said boot on said ski, said jaws being disposed in a predetermined relationship relative to said reference point on said ski; a member fixed on said ski and provided with guiding means slidably receiving therein each said jaw; an inverse drive mechanism connecting said jaws and acting along the longitudinal axis of said ski for moving simultaneously said jaws in opposite directions from and towards said reference point on said ski; and single control means operating said inverse drive mechanism.

2. A system according to claim 1, wherein said drive mechanism comprises at least one speed-reducing element designed to co-operate with at least one of said jaws, to allow said one jaw to be driven at a speed differing from that of the other jaw.

3. A system according to claim 1, further comprising locking means ensuring that said jaws are locked in relation to each other when said drive mechanism is out of action.

4. A system according to claim 3, wherein said locking means is said drive mechanism.

5. A system according to claim 3, wherein said locking means is independent of said drive mechanism and co-operates directly with one of said jaws.

6. A system according to claim 1, wherein said drive mechanism comprises: a primary rack secured to one of said jaws; a secondary rack secured to the other jaw; at least one pair of integral pinions meshing respectively with one of said primary and secondary racks; and a control pinion adapted to be operated by the skier and meshing with one of said two racks for displacing said one rack.

7. A system according to claim 6, wherein the step-down ratio between the two pinions of a pair is ⅓, the larger diameter pinion meshing with the primary rack.

8. A system according to claim 1, wherein said drive mechanism comprises: a first cable attached to one of the jaws and to a rotating control shaft adapted to be operated by the skier and further connected to said one jaw and to at least the first of a pair of integral pulleys free to rotate about a vertical axis; at least one secondary cable running between the second jaw and the second of the pair of pulleys; and a resilient element provided for the purpose of urging the two jaws towards each other.

9. A system according to claim 8, wherein the diameter of the first pulley is 3 times that of the second.

10. A system according to claim 1, wherein said drive mechanism consists of an axial rod mounted in bearing means adapted to prevent said rod to move axially in relation to the ski but to allow said rod to rotate, said rod having two sections with opposite threads engaging respectively in threaded holes in said front and rear jaws.

11. A system according to claim 10, wherein the pitch of the thread on one of the threaded sections is three times that of the other.

* * * * *